US005214482A

United States Patent [19]

Katoh

[11] Patent Number: 5,214,482

[45] Date of Patent: May 25, 1993

[54] ROTARY AGITATOR FOR AIDING REMOVAL OF TONER FROM A PHOTOCONDUCTIVE ELEMENT

[75] Inventor: Kazuyuki Katoh, Tokyo, Japan

[73] Assignee: Ricoh Company, Ltd., Tokyo, Japan

[21] Appl. No.: 511,103

[22] Filed: Apr. 19, 1990

[30] Foreign Application Priority Data

Apr. 26, 1989 [JP] Japan ..... 1-48231[U]
Feb. 19, 1990 [JP] Japan ..... 2-36234

[51] Int. Cl.[5] ..... G03G 21/00
[52] U.S. Cl. ..... 355/298; 355/299
[58] Field of Search ..... 355/298, 299, 296; 15/256.5, 256.51

[56] References Cited

U.S. PATENT DOCUMENTS

| | | | |
|---|---|---|---|
| 3,634,077 | 1/1972 | Sullivan | 15/256.5 |
| 4,140,389 | 2/1979 | Franke et al. . | |
| 4,325,628 | 4/1982 | Torigai et al. | 118/652 |
| 4,659,212 | 4/1987 | Ichihara et al. | 15/256.51 |
| 4,806,981 | 2/1989 | Ishiguro et al. | 355/298 |
| 4,974,030 | 11/1990 | Tokunaga et al. | 355/296 |

FOREIGN PATENT DOCUMENTS

| | | | |
|---|---|---|---|
| 2613235 | 10/1977 | Fed. Rep. of Germany . | |
| 3639385 | 5/1987 | Fed. Rep. of Germany . | |
| 3739071 | 5/1988 | Fed. Rep. of Germany . | |
| 61-63875 | 4/1986 | Japan | 355/298 |
| 61-204670 | 9/1986 | Japan | 355/298 |
| 62-244082 | 10/1987 | Japan | 355/298 |

OTHER PUBLICATIONS

Patent Abstracts of Japan, vol. 7, No. 210 (P-223) (1355), Sep. 16, 1983, & JP-A-58-105-278, Jun. 23, 1983, Y. Sawai, "Cleaning Device of Copying Machine".

Patent Abstracts of Japan, vol. 8, No. 60 (P-262) (1497), Mar. 22, 1984, & JP-A-58-211-180, Dec. 8, 1983, M. Suzuki, et al., "Cleaning Device of Electrophotography".

Patent Abstracts of Japan, vol. 10, No. 364, (P-524) (2421), Dec. 5, 1986, & JP-A-61-159-680, Jul. 19, 1986, K. Ito, et al., "Cleaning Device".

Patent Abstracts of Japan, vol. 7, No. 54 (P-180) (1199), Mar. 4, 1983, & JP-A-57-201-280, Dec. 9, 1982, T. Sugiyama, "Cleaning Device".

Patent Abstracts of Japan, vol. 9, No. 9 (P-327) (1732), Jan. 16, 1985, & JP-A-59-155-877, Sep. 5, 1984, H. Miyake, et al., "Cleaning Device".

Xerox Disclosure Journal, vol. 8, No. 5, Sep./Oct. 1983.

*Primary Examiner*—R. L. Moses
*Attorney, Agent, or Firm*—Oblon, Spivak, McClelland, Maier & Neustadt

[57] ABSTRACT

A cleaning device for use in image forming equipment has a cleaning blade for removing a toner remaining on an image carrier in the form of a photoconductive element, and a toner discharge coil for driving the removed toner out of the device. A rotatable member is interposed between the blade and the coil and between the coil and the photoconductive element. The toner scraped off the photoconductor element by the blade falls onto the rotatable member and is thereby transported to the coil.

9 Claims, 5 Drawing Sheets

ROTARY AGITATOR FOR AIDING REMOVAL OF TONER FROM A PHOTOCONDUCTIVE ELEMENT

BACKGROUND OF THE INVENTION

The present invention relates to a cleaning device for use in image forming equipment for removing a toner remaining on an image carrier in the form of a photoconductive element after image transfer by an elastic cleaning blade and discharging the removed toner by a toner discharge coil.

Generally, an electrophotographic copier or similar image forming equipment using an electrophotographic procedure has an image carrier which is implemented as a photoconductive drum. A toner remaining on the drum after the transfer of a toner image from the drum to a paper sheet is removed by a cleaning device. The cleaning device is often implemented by an elastic cleaning blade for scraping off the remaining toner from the drum in contact with the drum, a toner discharge coil for driving the removed toner out of the cleaning device, and a casing accommodating the blade and coil. While this type of cleaning device is in operation, the toner restricted by the cleaning blade sequentially accumulates on the underside of the blade. As soon as the mass of the toner accumulating on the underside of the blade exceeds a certain amount, it sequentially moves downward against the rotation of the drum and falls. The toner fallen from the blade accumulates between the toner coil and the drum and hardens there, resulting in so-called toner blocking. The toner block sequentially grows until it reaches the blade. Such a phenomenon is apt to occur when the fluidity of toner is low, especially when the ambient temperature of the cleaning device is high. The toner block reached the blade urges it upward to produce a substantial gap between the drum and the blade, preventing the cleaning device from cleaning the drum to an expected degree. To eliminate toner blocking, a brush may be held in contact with the drum between the blade and the coil, as already proposed in the art. The brush serves to reduce the amount of toner reaching the blade by bushing off the toner from the drum.

However, although the brush mentioned above may enhance efficient cleaning, it is too expensive to be installed in an inexpensive popular type of copier. Further, the pressure ascribable to the rotation of the brush causes the toner in the cleaning casing to scatter around even to the outside of the casing, resulting in the need for a casing having greater sealability and, therefore, in the increase in cost. For this reason, many of inexpensive copiers do not use such a brush and, therefore, suffer from the previously stated toner blocking.

SUMMARY OF THE INVENTION

It is therefore an object of the present invention to provide a cleaning device for image forming equipment which eliminates the drawbacks particular to the prior art as discussed above.

It is another object of the present invention to provide a cleaning device for image forming apparatus which exhibits a stable cleaning function at all times.

It is another object of the present invention to provide a cleaning device for image forming equipment which eliminates the accumulation and blocking of removed toner.

It is another object of the present invention to provide a cleaning device for image forming equipment which collects a toner efficiently.

It is another object of the present invention to provide an inexpensive cleaning device for image forming apparatus.

It is another object of the present invention to provide a generally improved cleaning device for image forming equipment.

A cleaning device for removing a toner remaining on a photoconductive element of image forming equipment of the present invention comprises a cleaning blade held in contact with the photoconductive element, a toner discharge coil located below the cleaning blade, and a rotatable member positioned between the cleaning blade and the toner discharge coil and between the toner discharge coil and the photoconductive element.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, a brief reference will be made to a prior art cleaning device for image forming equipment.

Figure 1:
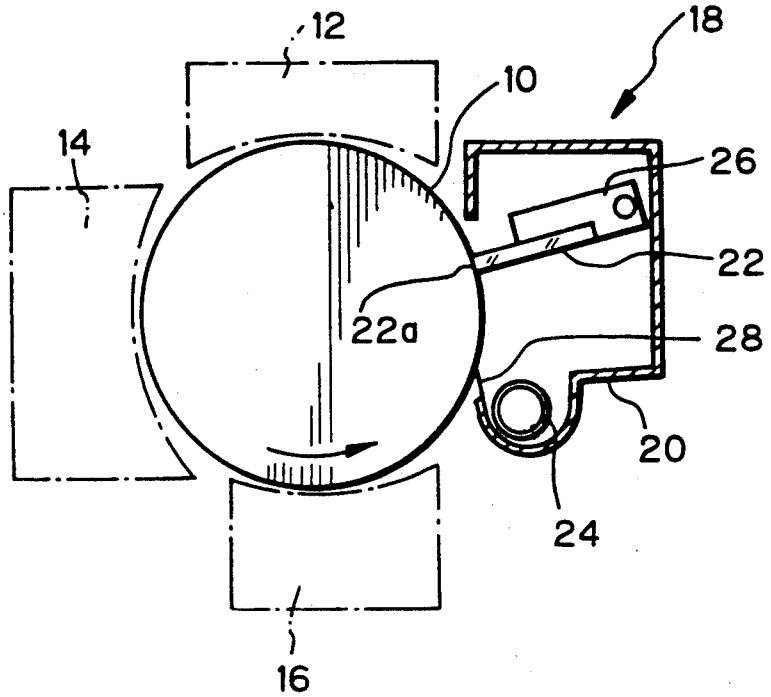
Fig. 1 PRIOR ART
FIG. 1 is a section showing a prior art cleaning device for image forming equipment.

Referring to FIG. 1, an electrophotographic copier, for example, generally has a photoconductive drum 10, and a charging and exposing section 12, a developing section 14 and an image transferring and paper separating section 16 which are arranged around the drum 10. A cleaning device 18 is also located in close proximity to the drum 10 for removing a toner which remains on the drum 10 after the transfer of a toner image to a paper sheet which occurs at the section 16. The cleaning device 18 has a cleaning casing 18, a cleaning blade 22 accommodated in the casing 20 and made of an elastic material, and a toner discharge coil 24 also accommodated in and disposed in a lower portion of the casing 20. The cleaning blade 22 is mounted on a blade support 26 and held in slidable contact with the drum at its tip 22*a*. The coil 24 is driven in a rotary motion by a drive mechanism, not shown, to convey the toner scraped off the drum 10 by the blade 22 toward an outlet. A seal member 28 serves to prevent the toner from leaking to the outside through the gap between the drum 10 and the casing 20.

Figure 2:
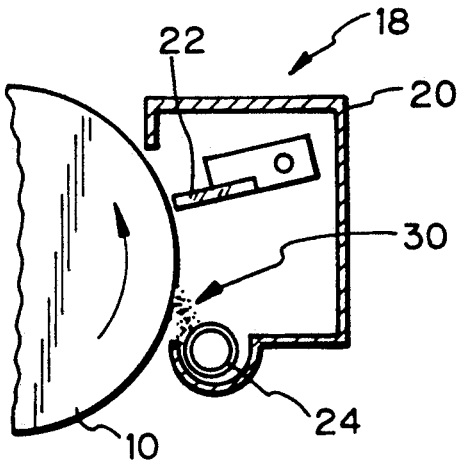
Fig. 2 PRIOR ART
FIGS. 2 and 3 are views demonstrating how a toner stays and forms a block in the prior art cleaning device shown in FIG. 1.
Figure 3:
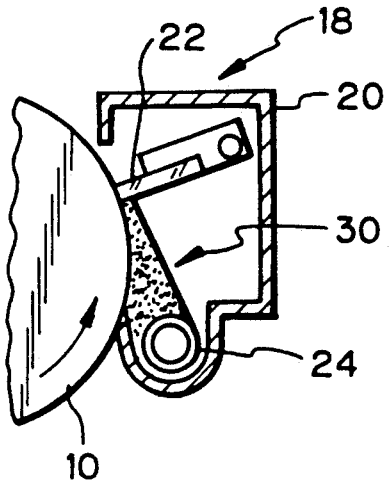
Fig. 3 PRIOR ART

While the cleaning device 18 is operated, the toner restricted by the cleaning blade 22 sequentially accumulates on the underside of the blade 22. As soon as the mass of the toner accumulating on the underside of the blade 22 exceeds a certain amount, it sequentially moves downward against the rotation of the drum 10 and falls. The toner fallen from the blade 22 accumulates between the toner discharge coil 24 and the drum 10 and hardens there, resulting in a toner block 30 as shown in FIG. 2. The toner block 30 sequentially grows until it reaches the blade 22, as shown in FIG. 3. Such a phenomenon is apt to occur when the fluidity of toner is low, especially when the ambient temperature of the cleaning device 18 is high, as stated earlier. The toner block 30 reached the blade 22 urges it upward to produce a substantial gap between the drum 10 and the blade 22, preventing the cleaning device 18 from cleaning the drum 10 to an expected degree. In the light of this, a brush is held in contact with the drum 10 between the blade 22 and the coil 24, although not shown in the figures. The brush serves to reduce the amount of toner reaching the blade 22 by brushing off the toner from the drum 10. However, such a brush is expensive and, therefore, not suitable for use in an inexpensive copier, as discussed previously.

Figure 4:
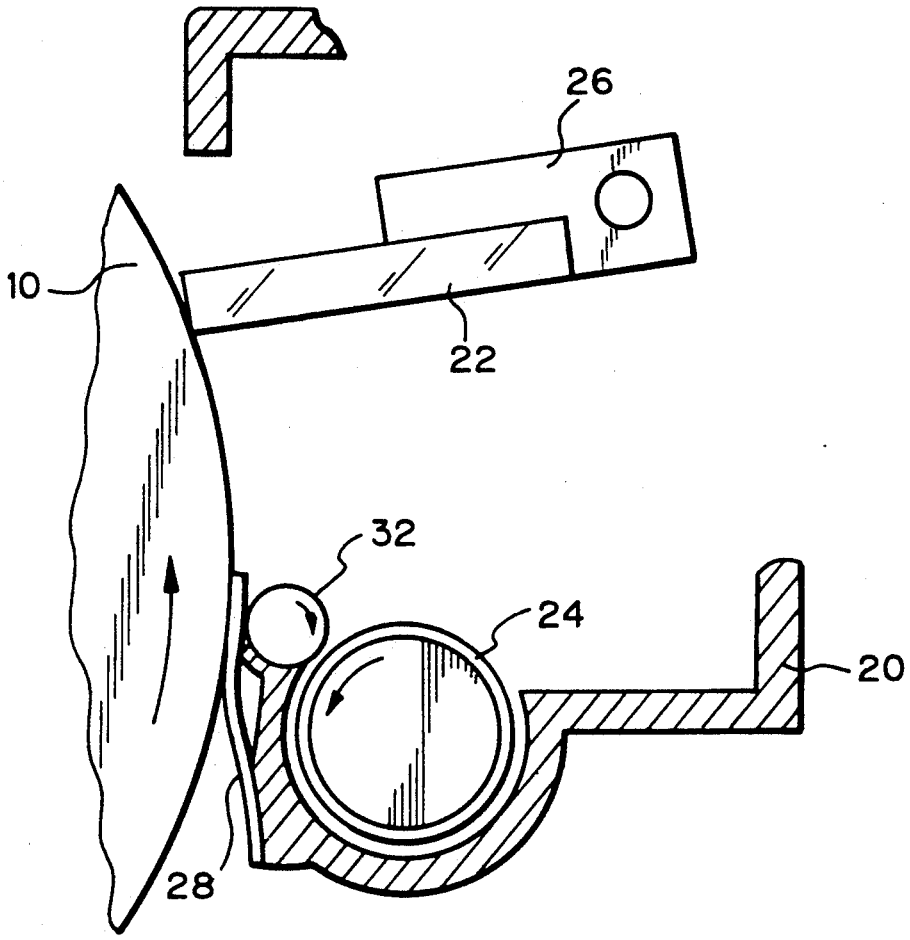
FIG. 4 is a section showing a cleaning device embodying the present invention.

Referring to FIG. 4, a cleaning device embodying the present invention is shown. In the figures, the same or similar components and structural elements are designated by like reference numerals, and redundant description will be avoided for simplicity.

Figure 5:
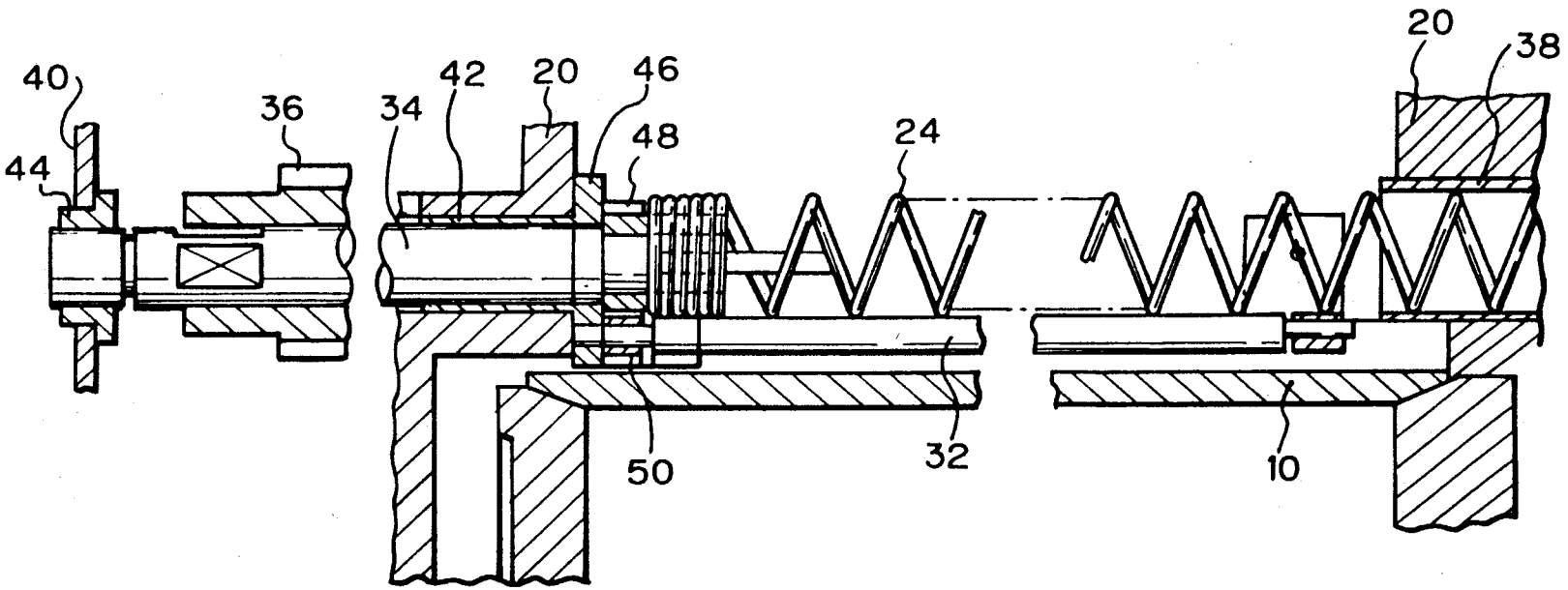
FIG. 5 is a view showing a section included in the illustrative embodiment for driving a toner discharge coil and an agitator.
Figure 6:
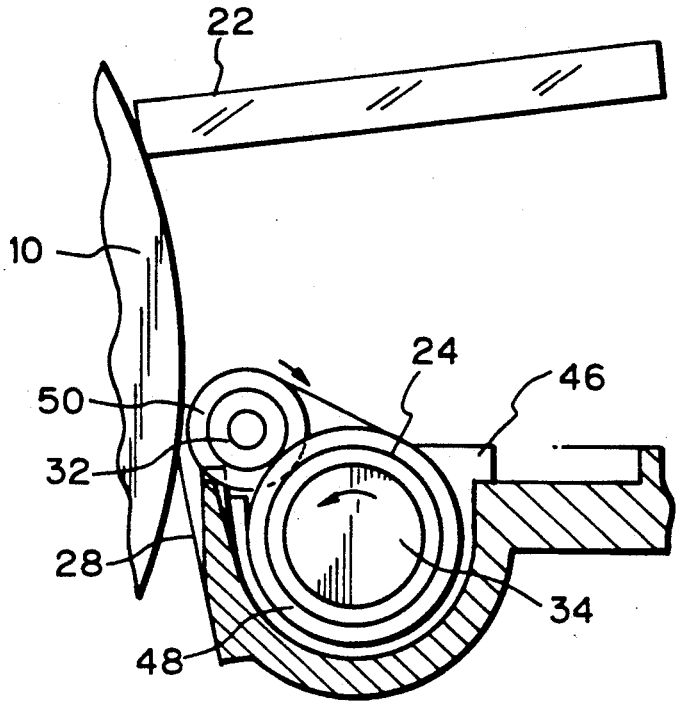
FIG. 6 is a section of the driving section shown in FIG. 5.

In FIG. 4, the cleaning device has a rotatable agitator 32 which is located between a drum 10 and a toner discharge coil 24 and between a cleaning blade 22 and the coil 24. The agitator 32 may be implemented as a rod of metal having a circular cross-section, as illustrated. As shown in FIGS. 4 and 5, a gear 36 is rigidly mounted on a drive shaft 34 and held in constant mesh with a drive gear of a driving section of the equipment. The coil 24 is rigidly fitted on the drive shaft 34 at one end thereof. At the other end, the coil 24 extends through a cleaning casing 20 into a discharge conduit 38. The drive shaft 34 is journalled to the casing 20 and a framework 40 by bearings 42 and 44, respectively. A support plate 46 is mounted on the bearing 42. A gear 48 is mounted on the drive shaft 34 between the support plate 46 and the portion of the coil 24 which is fitted on the drive shaft 34. The gear 48 is held in mesh with a gear 50 which is mounted on the agitator 32, whereby the agitator 32 is driven in a rotary motion. A toner scraped off the drum 10 by the blade 22 falls onto the agitator 32 which then drives the toner toward the coil 24 due to its rotation. The coil 24 which is also rotating drives the toner out of the casing 20 through the conduit 38. Such a configuration is successful in preventing the toner from forming a block 30, FIGS. 2 and 3, between the drum 10 and the coil 24.

Experiments showed that the illustrative emvodiment of FIG. 4 is operable in a desirable manner when the drum 10 is rotated at a linear velocity of 80 millimeters per second, the coil 24 has an outside diameter of 12 millimeters and is rotated at a rate of 100 revolutions per minute, and the agitator 32 is implemented as a rod of stainless steel whose diameter is 4 millimeters and is rotated at a rate of 200 revolutions per minute.

Figure 7:
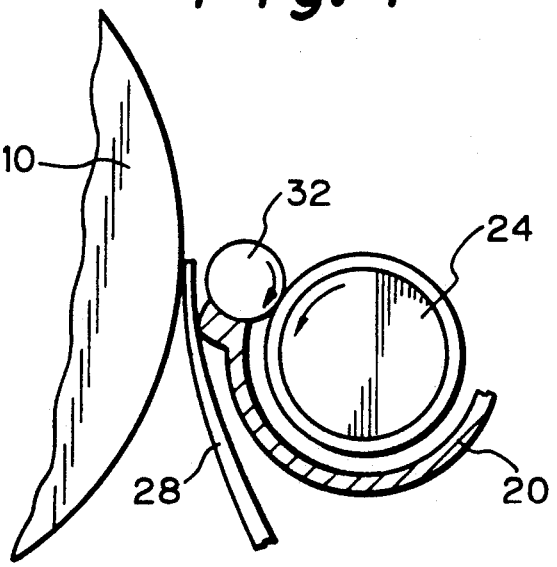
FIGS. 7, 8 and 9 are sections each showing an alternative embodiment of the present invention.

Referring to FIG. 7, an alternative embodiment of the present invention is shown. In the figures, the same or similar components and structural elements are designated by like reference numerals, and redundant description will be avoided for simplicity. In this particular embodiment, the agitator 32 and toner discharge coil 24 are held in contact with each other so that toner adhered to the agitator 32 may be scraped off by the coil 24. Stated another way, the coil 24 serves to clean the agitator 32 at all times. This frees the drum 10 from the influence of the agitator 32 which would otherwise sequentially increase in diameter due to the deposition of toner particles.

Figure 8:
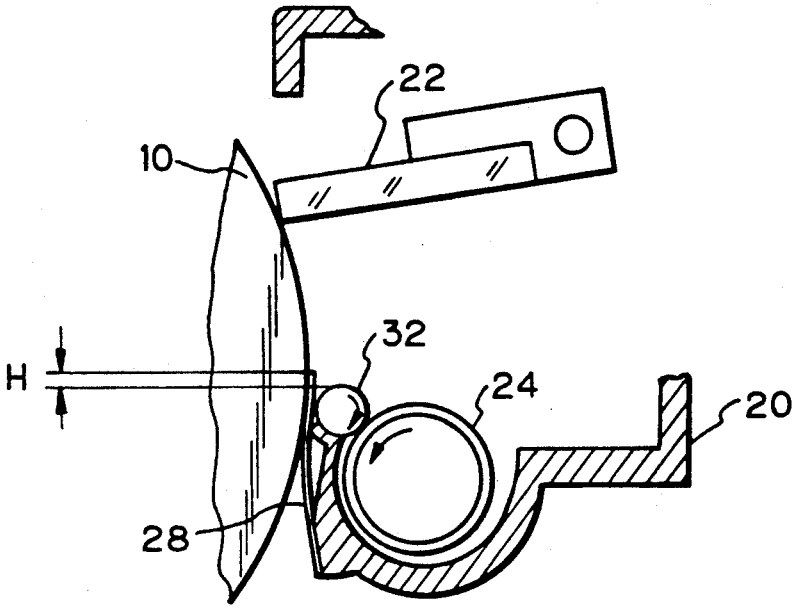

FIG. 8 shows another alternative embodiment of the present invention. As shown, the seal member 28 extends above the agitator 32 by a distance H. Such a configuration of the seal member 28 is advantageous in that when the agitator 32 is accidentally shifted toward the drum 10 by some cause, the seal member 28 prevents the agitator 32 from scratching or otherwise damaging the drum 10.

Figure 9:
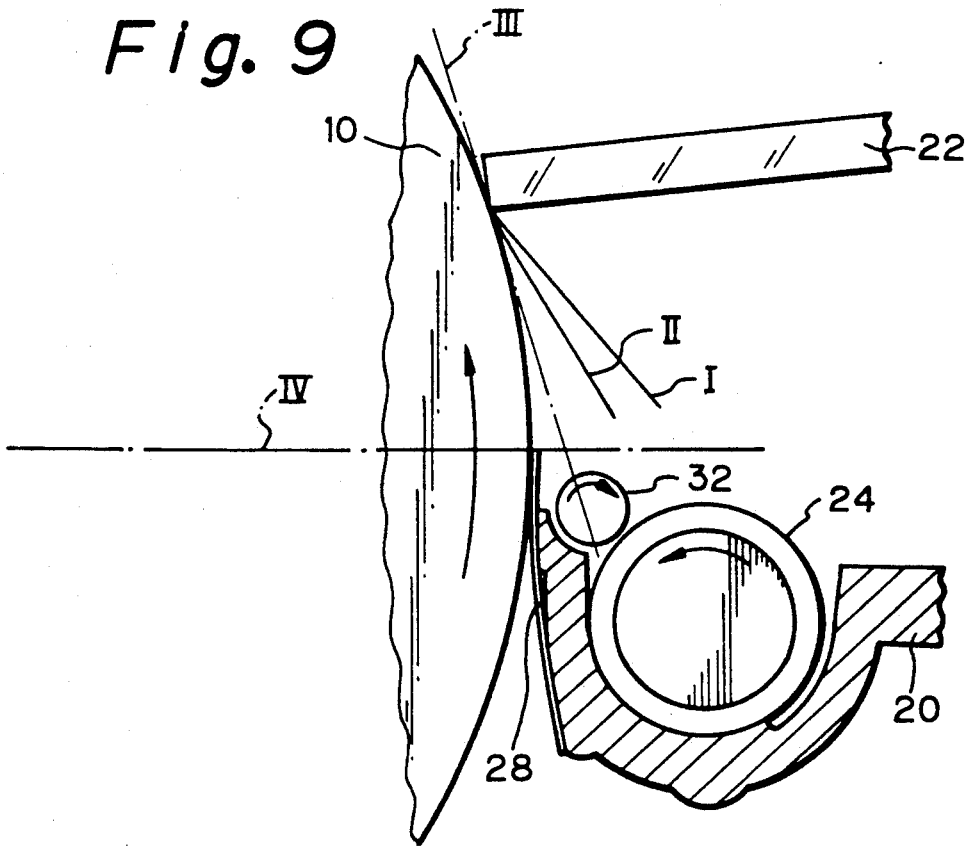

The accumulation and blocking of toner particles has been described with reference to FIGS. 2 and 3. Concerning the contour of toner accumulation, as shown in FIG. 9, toner sequentially accumulates at the outside of a line III tangential to the drum 10 at the point of contact of the drum 10 and blade 22, as indicated by line I and II. More specifically, the contour lines I and II will never be located at the inside of the tangential line III, i.e., closer to the drum 10 than the tangential line III. Therefore, if the agitator 32 is at least partly positioned at the inside of the tangential line III, it can eliminate at least toner blocking of the kind which has influence on the blade 22.

As shown in FIG. 9, the agitator 32 is located below a horizontal line IV which extends through the center of the drum 10. This allows the agitator 32 to efficiently receive the toner which are let fall by gravity, thereby enhancing efficient toner collection.

Furthermore, since the agitator 32 is rotated in the opposite direction to the drum 10, the toner to be collected is easy to collapse and is moved away from the drum 10, whereby efficient toner collection is further enhanced.

In summary, it will be seen that the present invention provides a cleaning device which prevents a toner from staying and thereby forming a block between a toner discharge coil and a cleaning blade. The cleaning device is, therefore, exhibits a stable cleaning function constantly and, yet, needs a minimum of cost.

Various modifications will become possible for those skilled in the art after receiving the teachings of the present disclosure without departing from the scope thereof.

What is claimed is:

1. A cleaning device for removing a toner remaining on a photoconductive element of image forming equipment, comprising:

a cleaning blade held in contact with the photoconductive element;

a toner discharge coil having a plurality of coil windings rigidly fitted on a drive shaft, said drive shaft being located below said cleaning blade; and a rotatable member positioned between said cleaning blade and said toner discharge coil and between said toner discharge coil and the photoconductive element, wherein said rotatable member is held in contact with said toner discharge coil, and means for driving said drive shaft so that said windings scrape along a surface of the rotatable member to remove toner therefrom and to simultaneously transport the toner along a longitudinal axis of the rotatable member.

2. A device as claimed in claim 1, further comprising a cleaning casing in which said cleaning blade, said toner discharge coil and said rotatable member are accommodated.

3. A device as claimed in claim 2, further comprising a seal member intervening between the photoconductive element and said cleaning casing.

4. A device as claimed in claim 3, wherein said seal member extends beyond said rotatable member.

5. A device as claimed in claim 1, wherein said rotatable member is at least partly located at the inside of a line tangential to the photoconductive element at a point of contact of said photoconductive element and said cleaning blade.

6. A device as claimed in claim 1, wherein said rotatable member is located below a horizontal line which extends through the center of the photoconductive element.

7. A device as claimed in claim 1, wherein said rotatable member is rotatable in a direction opposite to an intended direction of rotation of the photoconductive element.

8. A device as claimed in claim 1, wherein said drive shaft includes means for engaging with said rotatable member to rotate said rotatable member.

9. A device as claimed in claim 2, wherein said toner discharge coil extends through an opening in said cleaning casing into a discharge conduit to remove toner from said cleaning casing.

* * * * *